US006839909B1

(12) United States Patent
Prince

(10) Patent No.: US 6,839,909 B1
(45) Date of Patent: Jan. 11, 2005

(54) PROTECTIVE COVERALL FOR ELECTRICAL UTILITY WORKERS

(76) Inventor: Erwin A. Prince, 255 E. 18th St., Apartment 5G, Brooklyn, NY (US) 11226

( * ) Notice: Subject to any disclaimer, the term of this patent is extended or adjusted under 35 U.S.C. 154(b) by 142 days.

(21) Appl. No.: 10/633,643

(22) Filed: Aug. 5, 2003

(51) Int. Cl.[7] ..... A41D 1/00
(52) U.S. Cl. ..... 2/81; 2/69
(58) Field of Search ..... 2/456–458, 2.11, 2/2.14–2.16, 46.82, 49.4, 272, 69, 69.5, 79, 227, 81, 83, 85, 92, 94, 97, 102, 108, 2.5, 228; 428/920, 921, 423.9, 443, 465, 492

(56) References Cited

U.S. PATENT DOCUMENTS

| | | | | | |
|---|---|---|---|---|---|
| 3,337,876 | A | * | 8/1967 | Armstrong | 2/2.15 |
| 3,660,849 | A | * | 5/1972 | Jonnes et al. | 2/2.15 |
| 4,397,043 | A | * | 8/1983 | Croteau | 2/456 |
| 4,583,247 | A | * | 4/1986 | Fingerhut et al. | 2/69 |
| 4,612,239 | A | * | 9/1986 | Dimanshteyn | 442/234 |
| 4,746,565 | A | * | 5/1988 | Bafford et al. | 442/243 |
| 4,860,382 | A | * | 8/1989 | Markwell | 2/457 |
| 4,890,336 | A | * | 1/1990 | Worton | 2/79 |
| 5,001,781 | A | * | 3/1991 | Grilliot et al. | 2/69 |
| 5,399,418 | A | | 3/1995 | Hartmanns et al. | |
| 5,640,718 | A | * | 6/1997 | Aldridge | 2/81 |
| 6,296,023 | B1 | | 10/2001 | Gehrhardt et al. | |
| 6,341,384 | B1 | | 1/2002 | Hayes | |
| 2002/0168908 | A1 | | 11/2002 | Gibson et al. | |

FOREIGN PATENT DOCUMENTS

| | | |
|---|---|---|
| JP | 2000-345418 | 12/2000 |

* cited by examiner

*Primary Examiner*—Tejash Patel
(74) *Attorney, Agent, or Firm*—Richard C. Litman

(57) ABSTRACT

The protective coveralls for electrical utility workers are designed to protect the wearer from fire and other thermal hazards, and particularly designed to insulate the rear half of the body of the wearer from direct contact with an electrical source up to 600 volts. The protective coverall has a front half is constructed from dual layers of fire-retardant fabric, and a rear half which includes electrical insulation provided by a rubber lining disposed between the outer and inner layer of fire-retardant fabric. The stitching on the rear half in the elbow and knee regions is done in concentric circles to increase flexibility.

9 Claims, 4 Drawing Sheets

PROTECTIVE COVERALL FOR ELECTRICAL UTILITY WORKERS

BACKGROUND OF THE INVENTION

1. Field of the Invention

The present invention relates to protective garments. More specifically, the invention is a protective coverall garment for use by electric utility workers constructed such that the rear half of the coverall features electrical insulation lining encased between two layers of fire-retardant fabric, thereby shielding the rear of the body of the user both from the harmful effects of fire and from an electric surge up to 600 volts.

2. Description of the Related Art

Many occupations and activities require that special protective garments be worn as a safety measure in order to shield the wearer from some associated, potentially harmful effect. This is particularly true for electric utility workers and the like who toil in potentially hazardous environments with the acute risks of fire and electrocution ever present. When working in the tight-fitting spaces of a manhole or other confined spaces, electrical utility workers often don fire retardant coveralls to protect their bodies from environmental hazards. As an additional precautionary measure, electrical utility workers cloak the front of their bodies with a rubber mat-type insulation device that shields the front of the body of the electrical utility workers and insulates the worker in the event of direct contact with an open end or other live electrical source. However, when wearing conventional coveralls, the rear of the body of the electrical utility worker is not protected from direct contact with an electrical source. Great care and attention are usually focused on the front half of the body of the electrical utility worker, but the rear half of the body is often left unprotected.

There exists a need to shield and insulate the rear half of the body of the electrical utility worker from exposure to an electrical source when working in a hazardous environment, such as a manhole. Advances in fire-retardant garments and the like have added an extra dimension of safety, but they provide limited protection for the rear half of the body of the wearer in the event of exposure to live cables without caps ("open ends"), or in a situation where a burn-out must be isolated. Various garments for protecting the body of the wearer have long been known and various inventions have been directed towards improving the electrical insulating quality of protective garments used by electrical utility workers and the like, but none disclose the protective garment construction of the present invention.

U.S. Patent Publication No. US 2002/0168908, published Nov. 14, 2002, discloses apparel crafted from flame-resistant fabric for use by workers who are exposed to momentary electric arcing and related thermal hazards. Similarly, U.S. Pat. No. 6,341,384, issued Jan. 29, 2002 to C. Hayes, shows a liner for use with protective garments to be worn in flashback conditions and/or electrical arcing conditions. However, both the '908 invention and the Hayes invention are primarily designed to retard a fire hazard caused by a momentary electric arcing mishap, as opposed to providing electrical insulation for the rear half of the body of an electrical utility worker or the like in the event of exposure to open ends.

U.S. Pat. No. 5,399,418, issued Mar. 21, 1995 to J. Hartmanns et al., teaches a textile fabric for space suits made from organic and metallic fibers and having an exterior coating, which may be a silicone coating applied as a thin film. The coating would include a metal oxide in a proportion of about 0.1 to 2.0% by weight, thereby bolstering the protection afforded by the garment against the effects of electrical charging.

Similarly, Japanese Patent No. 2000-345,418, published Dec. 12, 2000, reveals electrical insulation clothing where the garment is laminated with electrical insulation resin films. The electrical insulating layer is primarily external to the garment and does not disclose the ability to protect the wearer from an electrical surge up to 600 volts.

U.S. Pat. No. 6,296,023, issued Oct. 2, 2001 to M. Gehrhardt et al., describes woven fabric for protective clothing intended to protect a wearer from heat, flames and the effects of electrical arcing. The Gehrhardt patent does not teach a flexible internal rear liner comprising a rubber composite that provides a layer of electrical insulation.

None of the above inventions and patents, taken either singly or in combination, is seen to describe the instant invention as claimed. Thus a protective coverall solving the aforementioned problems is desired.

SUMMARY OF THE INVENTION

The protective coverall of the present invention is generally designed to protect the wearer from fire and other thermal hazards, and particularly includes protection for the rear half of the body of electrical utility workers from the effects of direct contact with an electrical source up to 600 volts. The protective coverall is a one-piece construction and envelops the torso, arms, and legs of the wearer, with the usual openings for the head/neck, hands, and feet of the wearer.

The front of the protective coverall is similar to that of conventional dual layer fire-retardant coveralls and houses a zipper assembly to facilitate ingress and egress of the protective coveralls by the wearer. The rear half of the protective coverall features a layer of electrical insulation encased by outer and inner layers of fire-retardant fabric. The layer of electrical insulation comprises a lining formed from rubber or a rubber composite disposed between the outer and inner layers of fire-retardant fabric. Stitching is used to join the three layers securely. The stitching on the rear half where the elbows and knees of the wearer bend is done in a concentric circle fashion to increase the flexibility of the protective coverall in the elbow and knee regions.

The electrical insulation lining is designed to protect the rear half of the body from an electrical surge up to 600 volts and to mitigate the harmful effects of direct contact with live electrical cables with no caps ("open ends") or other live electrical sources. Moreover, when a burn-out is present, the protective coverall of the present invention offers an extra level of safety to shield the rear half of the wearer from harm. In addition, the fire-retardant nature of the outer layer and inner layer of coverall fabric provides protection from fire and other thermal hazards encountered by electrical utility workers and the like.

Accordingly, it is a principal object of the invention to provide a protective coverall, particularly for electrical utility workers that shield the rear of the body of the wearer from an electric surge up to 600 volts.

It is another object of the invention to provide a protective coverall that protects the wearer from fire and other thermal hazards.

It is a further object of the invention to provide a protective coverall with increased flexibility.

Still another object of the invention is to provide a protective coverall that is easy to make, comfortable, and effective for providing protection from both fire and electrical hazards.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
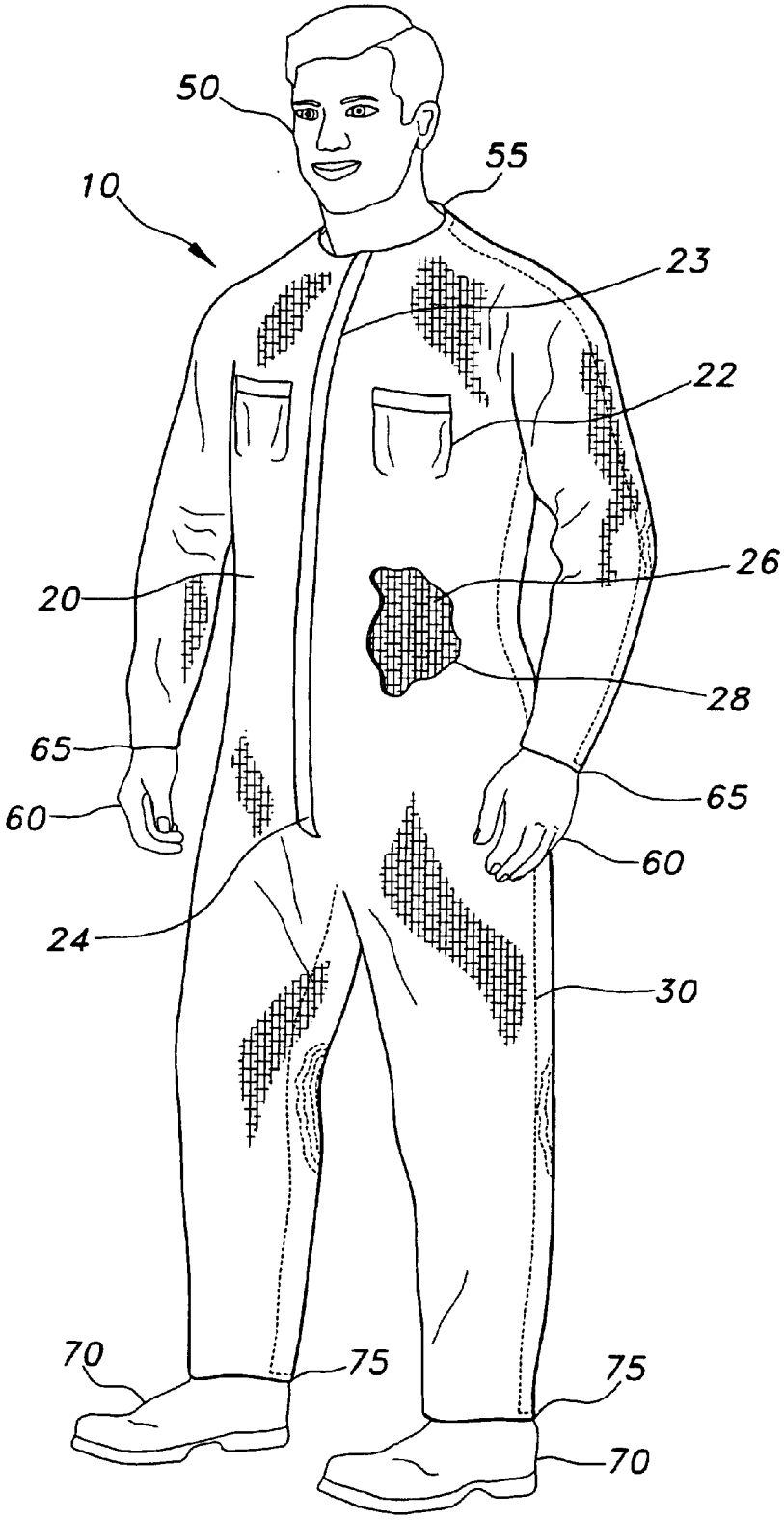
FIG. 1 is an environmental perspective view, as seen from the front, of an individual wearing the protective coverall according to the present invention, a portion of the outer layer being broken away.

The present invention is a protective coverall, designated generally as 10 in the drawings. Referring to FIG. 1, the protective coverall 10 is a loose-fitting one-piece work garment worn to protect the clothes and the body of the wearer that features electrical insulation designed to protect the rear half of the person from direct contact with a live electrical source up to 600 volts, and made with fire-retardant fabric throughout in order to shield the wearer from the harmful effects of fire and other thermal hazards.

Referring to FIG. 1, the protective coverall 10 is a loose-fitting, one-piece garment. The protective coverall 10 has a front half 20 and a rear half 30 that are joined by stitching. The protective coverall 10 envelops the arms, legs, and torso region of the wearer. In accordance, the protective coverall 10 has openings 55,65,75 that respectively allow the head/neck 50, hands 60, and feet 70 of the wearer to exit, thereby leaving those body components uncovered by the protective coverall 10.

Still referring to FIG. 1, in the preferred embodiment, the front half 20 of the protective coverall 10 is constructed from dual layers 26,28 of fire-retardant fabric, as seen in the portion of the coverall 10 broken away in FIG. 1. The inner layer 26 of fire-retardant fabric is mated to the underside of the outer layer 2B, also of fire-retardant fabric, by stitching. Alternatively, the front half 20 of the protective coverall 10 could consist of a single layer of fire-retardant fabric. A zipper assembly 24 is provided for permitting the user to put the coverall 10 on and to take it off. The zipper assembly 24 is defined by a vertical split 23 in the protective coverall 10 that begins at the middle of the neck opening 55 and extends downward to the bottom area of the torso, in conventional manner. Pockets 22 may be attached on each side of the zipper assembly 24.

Figure 2:
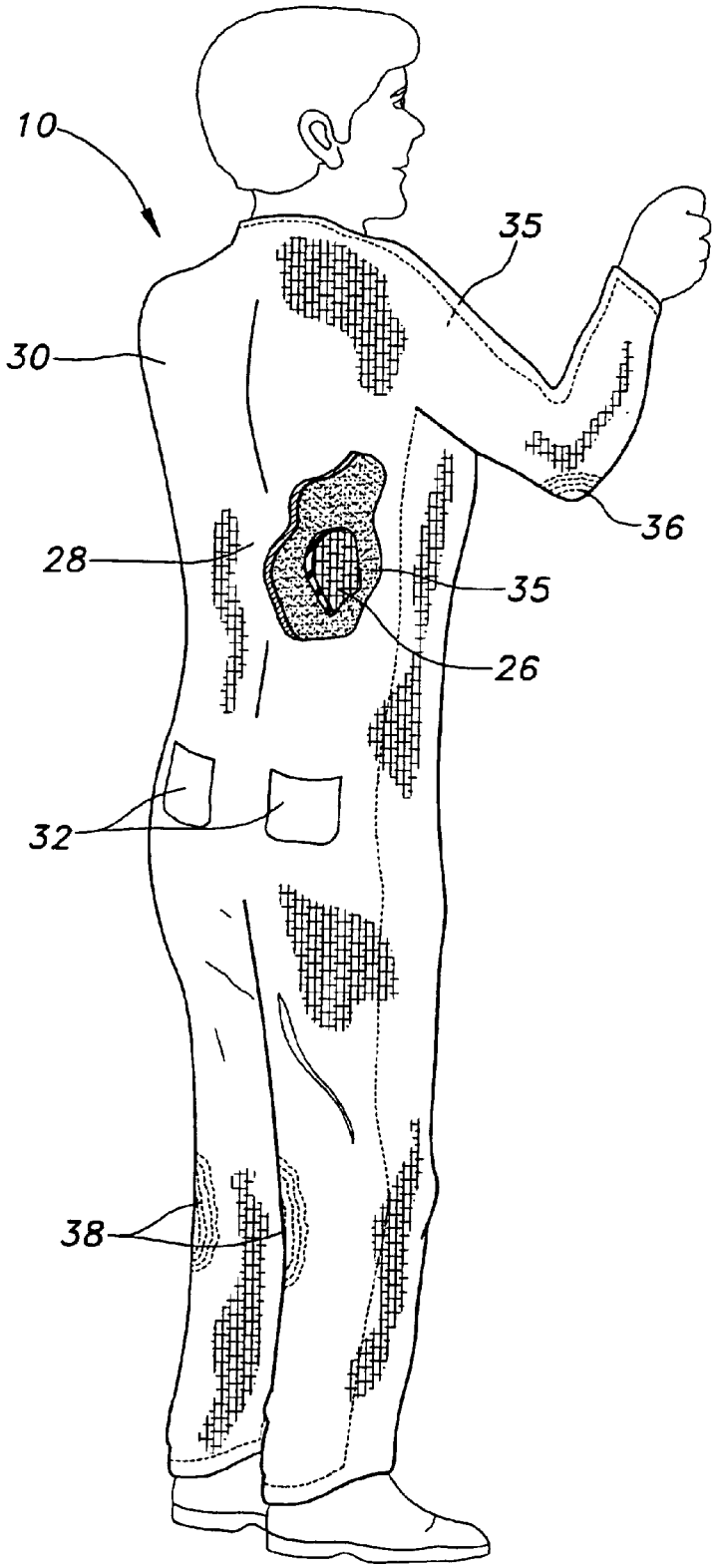
FIG. 2 is an environmental perspective view, as seen from the rear, of an individual wearing the protective coverall according to the present invention, a portion of the outer layer and electrical insulating layer being broken away.

Referring to FIG. 2, the rear half 30 of the protective coverall 10 houses the electrical insulation lining 35 that serves as a shield to insulate the rear half of an electrical utility worker from exposure to a live electrical source up to 600 volts. Typically, when working in confined spaces such as manholes, electrical utility workers cloak the front of their bodies with a rubber mat-type insulation device, separate from any coverall worn by the worker, that shields the front of the body of the electrical utility worker and insulates the worker in the event of direct contact with an electrical source. The electrical insulation lining 35 affords the wearer the same protection for the rear half of the electrical utility worker.

In the preferred embodiment, the electrical insulation lining 35 is made from rubber, either natural or synthetic, or a rubber composite capable of providing the insulation necessary to protect the wearer from exposure up to 600 volts. However, the composition of the electrical insulation lining 35 is not limited to rubber or a rubber composite, but can made from any number of synthetic elastic materials of varying chemical makeup that exhibit similar electrical insulating properties as the preferred embodiment.

The electrical insulation lining 35 is disposed between the outer layer 28 and inner layer 26 of the garment only on the rear half 30 of the coverall. The electrical insulation lining 35 may be attached to the outer layer 28 and the inner layer by stitching, or by any other means known in the art for attaching a rubber lining to fabric. In addition, pockets 32 can be attached on each side of the lower torso region of the protective coverall 10 on the outer layer 28 of the rear half 30.

Figure 3:
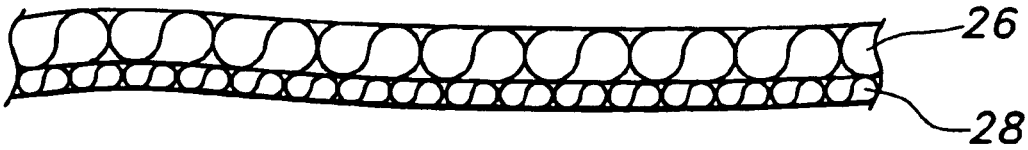
FIG. 3 is a fragmented section view through the front of the protective coverall of the present invention showing the outer and inner layers.

Referring to FIG. 3, the section view of the front half 20 of the protective coverall 10 shows an outer layer 28 made from a fire-retardant fabric or textile material to which a thinner inner layer 26 made from fire-retardant fabric or textile material is attached by stitching or other conventional means.

Figure 4:
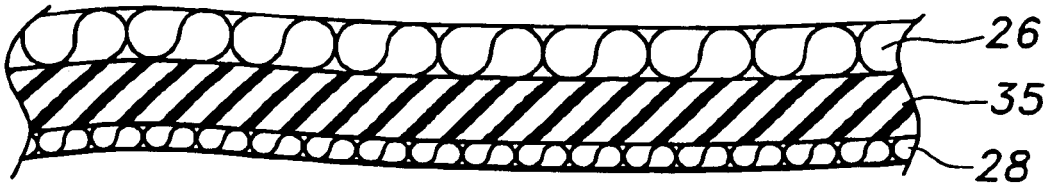
FIG. 4 is a fragmented section view of the rear of the protective coverall of the present invention showing the three layers of material.

Referring to FIG. 4, the section view of the rear half 30 of the protective coverall 10 shows fire-retardant fabric of the outer layer 28 atop the layer of rubber or rubber composite of the electrical insulation lining 35 which rests upon the fire-retardant fabric of the inner layer 26. The electrical insulation lining 35 is encased between the outer layer 28 and the inner layer 26 and stitched together to form the rear half 30 of the protective coverall 10.

Figure 5:
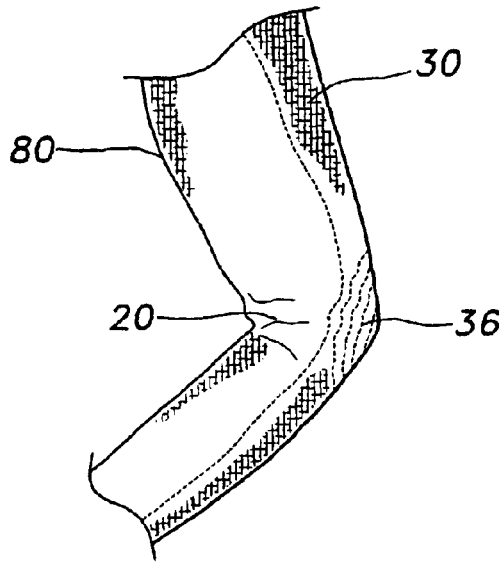
FIG. 5 is a fragmented perspective view of an elbow region of the protective coverall of the present invention.

Referring to FIG. 5, the elbow region 80 of the protective coverall 10 is shown. The elbow region 80 of the protective coverall 10 must be flexible enough to accommodate the bending and movement of the elbow of the wearer when the protective coverall 10 is worn. To facilitate movement by wearer in the elbow region 80 on the rear half 30 that is defined by the three-layer construction, the stitching pattern 36 is done in concentric circles. This concentric circle-stitching pattern 36 affords the wearer greater flexibility in the elbow region 80 when the wearer bends his or her elbow(s).

Figure 6:
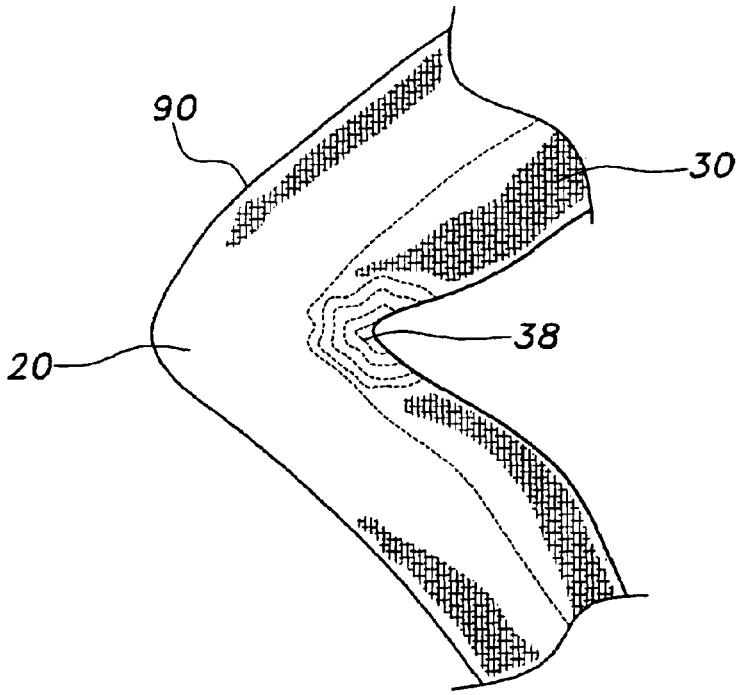
FIG. 6 is a fragmented perspective view of a knee region of the protective coverall of the present invention.

Referring to FIG. 6, the knee region 90 of the protective coverall 10 is shown. The knee region 90 of the protective coverall 10 must be flexible enough to accommodate the bending and movement of the knee(s) of the wearer when the protective coverall 10 is worn. To facilitate movement by the wearer in the knee region 90 on the rear half 30 that is defined by the three-layer construction, the stitching pattern 36 is done in concentric circles. This concentric circle-stitching pattern 36 affords the wearer greater flexibility in the knee region 80 when the wearer bends his or her knee(s).

In alternative embodiments, the electrical insulation lining can be adapted to encompass the front half of the protective coverall as well. In addition, the protective coverall can be an assembly of parts as opposed to a one-piece construction, depending on ease of manufacturing. Furthermore, the electrical insulation lining may be adapted to an unlimited number of types of safety apparel to insulate the wearer from an electrical surge.

The inner layer 26 and the outer layer 28 may be made from any fire-resistant fabric meeting ANSI standards for flammability for protective clothing used by electrical utility workers.

It is to be understood that the present invention is not limited to the embodiments described above, but encompasses any and all embodiments within the scope of the following claims.

I claim:

1. A protective coverall garment for an electrical utility worker, comprising:

a central body portion adapted for covering a torso of the worker from neck to crotch;

a pair of sleeves extending from the central body portion adapted for covering arms of the worker from shoulder to wrist; and a pair of pant legs extending from the central body portion adapted for covering legs of the worker from hip to ankle;

wherein the garment has a front half, the front half being made from at least one layer of fire-retardant fabric, and a rear half joined to the front half to form the coverall, the rear half being made from inner and outer layers of fire-retardant fabric and an electrical insulating layer disposed between the inner and outer layers in each of the central body portion, the sleeves, and the pant legs.

2. The protective coveralls according to claim 1, wherein said electrical insulating layer comprises natural rubber.

3. The protective coveralls according to claim 1, wherein said electrical insulating layer comprises synthetic rubber.

4. The protective coveralls according to claim 1, wherein said electrical insulating layer comprises a composite material containing rubber.

5. The protective coveralls according to claim 1, wherein said electrical insulating layer has electrical insulating properties capable of withstanding an electrical arc of up to 600 volts.

6. The protective coveralls according to claim 1, wherein said sleeves each comprise an elbow region, said sleeves having concentric circles of stitching attaching the electrical insulating layer to said inner and outer layers for flexibility when bending the elbow.

7. The protective coveralls according to claim 1, wherein said pant legs each comprise a knee region, said pant legs having concentric circles of stitching attaching the electrical insulating layer to said inner and outer layers for flexibility when bending the knee.

8. The protective coveralls according to claim 1, wherein said front half is made from a material consisting of two layers of fire-retardant fabric joined together.

9. The protective coveralls according to claim 1, further comprising a zipper assembly disposed in the front half of said central body portion.

* * * * *